US011122872B2

(12) United States Patent
He et al.

(10) Patent No.: US 11,122,872 B2
(45) Date of Patent: Sep. 21, 2021

(54) SHADE UMBRELLA FOR FACILITATING FOLDING OF UMBRELLA SURFACE

(71) Applicant: ZHEJIANG WEIGE ARTS & CRAFTS CO., LTD, Zhejiang (CN)

(72) Inventors: Yong He, Zhejiang (CN); Sheng Ye, Zhejiang (CN); Haixing Chen, Zhejiang (CN)

(73) Assignee: ZHEJIANG WEIGE ARTS & CRAFTS CO., LTD, Zhejiang (CN)

( * ) Notice: Subject to any disclaimer, the term of this patent is extended or adjusted under 35 U.S.C. 154(b) by 0 days.

(21) Appl. No.: 16/894,891

(22) Filed: Jun. 8, 2020

(65) Prior Publication Data

US 2020/0297086 A1 Sep. 24, 2020

Related U.S. Application Data

(63) Continuation of application No. PCT/CN2019/108022, filed on Sep. 26, 2019.

(30) Foreign Application Priority Data

Dec. 31, 2018 (CN) ..... 201811649836.9
Dec. 31, 2018 (CN) ..... 201822262466.5

(51) Int. Cl.
*A45B 25/14* (2006.01)
*A45B 23/00* (2006.01)

(52) U.S. Cl.
CPC ..... *A45B 25/14* (2013.01); *A45B 2023/0012* (2013.01); *A45B 2023/0037* (2013.01)

(58) Field of Classification Search
CPC ..... A45B 2025/146; A45B 2023/0031; A45B 2023/0037; A45B 2023/005; A45B 2023/0081; A45B 2023/0012; A45B 25/14; A45B 19/04; A45B 2019/008
See application file for complete search history.

(56) References Cited

U.S. PATENT DOCUMENTS 3,870,062 A * 3/1975 Medlin ..... A45B 19/04 135/20.3
4,424,824 A * 1/1984 Becher ..... A45B 19/04 135/20.3

(Continued)

FOREIGN PATENT DOCUMENTS

CN 201097727 8/2008
CN 201123464 10/2008
CN 206453378 9/2017

*Primary Examiner* — Noah Chandler Hawk
(74) *Attorney, Agent, or Firm* — JCIP Global Inc.

(57) ABSTRACT

An umbrella for facilitating folding of umbrella surface includes an umbrella surface assembly and a pole assembly that are cooperatively connected to each other. The umbrella surface assembly includes a middle stick, an upper umbrella tray, a lower umbrella tray, a set of first cross rods and a set of second cross rods. The upper umbrella tray is hingedly connected to a first diagonal draw bar, a middle portion of the first diagonal draw bar is hingedly connected to a second diagonal draw bar, and a lower end of the first diagonal draw bar is hingedly connected to a sliding portion. The pole assembly includes an outer pole, an inner telescopic rod slidably connected to the outer pole, a traction device and an elastic element.

10 Claims, 5 Drawing Sheets

(56) References Cited

U.S. PATENT DOCUMENTS

| | | | | |
|---|---|---|---|---|
| 5,386,842 | A * | 2/1995 | Becher | A45B 23/00 135/20.3 |
| 5,752,534 | A * | 5/1998 | Becher | A45B 23/00 135/15.1 |
| 6,305,394 | B1 * | 10/2001 | Reese | A45B 11/00 135/20.1 |
| 6,401,735 | B1 * | 6/2002 | Chou | A45B 23/00 135/20.1 |
| 6,923,193 | B2 * | 8/2005 | Chen | A45B 23/00 135/20.1 |
| 9,167,873 | B2 * | 10/2015 | May | A45B 23/00 |
| 10,925,361 | B2 * | 2/2021 | Ma | A45B 25/02 |
| 2004/0177871 | A1 * | 9/2004 | Harbaugh | A45B 19/10 135/20.1 |
| 2005/0016571 | A1 * | 1/2005 | Wu | A45B 25/165 135/20.1 |

* cited by examiner

SHADE UMBRELLA FOR FACILITATING FOLDING OF UMBRELLA SURFACE

CROSS-REFERENCE TO RELATED APPLICATION

This application is a continuation of international PCT application Serial no. PCT/CN2019/108022, filed on Sep. 26, 2019, which claims the priority benefit of China applications no. 201811649836.9 and no. 201822262466.5, filed on Dec. 31, 2018. The entirety of each of the above-mentioned patent applications is hereby incorporated by reference herein and made a part of this specification.

BACKGROUND

Technical Field

The disclosure belongs to the technical field of outdoor umbrellas, in particular, to an umbrella for facilitating folding of umbrella surface.

Description of Related Art

Shade umbrellas are common outdoor items in our daily lives. The shade umbrellas are divided into center-pole type and side-pole type, wherein for the center-pole type shade umbrella, since the pole is in the center of the umbrella surface, the area under the umbrella is too small, which is not convenient. For the side-pole type, since the pole is set on the side of the umbrella surface, the problem of too small area under the umbrella is perfectly solved.

Typically, the shade umbrella includes a pole and an umbrella surface assembly, wherein the umbrella surface assembly includes a middle stick, a cross rod, an upper umbrella tray, a lower umbrella tray and an umbrella surface. When the umbrella is folded, the height of the upper umbrella tray is unchanged, so that the function of folding the umbrella may be achieved by moving the upper umbrella tray upward to fold the cross rod. At present, for the shade umbrellas in the market, since the umbrella surface is large, the umbrella bone is so close to the ground when the umbrella is folded that it will touch the table under the umbrella and items on the table when folding and unfolding the umbrella, and also the effect of shading will not be achieved if the umbrella edge is too high

SUMMARY

In order to make up for the deficiencies of the prior art, the disclosure provides a technical solution of a shade umbrella for facilitating folding of umbrella surface.

The shade umbrella for facilitating folding of umbrella surface includes an umbrella surface assembly and a pole assembly that are cooperatively connected to each other. The umbrella surface assembly includes a middle stick, an upper umbrella tray and a lower umbrella tray that are cooperatively connected to each other, a set of first cross rods and a set of second cross rods. The upper umbrella tray is hingedly connected to a first diagonal draw bar, a middle portion of the first diagonal draw bar is hingedly connected to a second diagonal draw bar, and a lower end of the first diagonal draw bar is hingedly connected to a sliding portion. The pole assembly comprises an outer pole, an inner telescopic rod slidably connected to the outer pole, a traction device and an elastic element. An upper end of the inner telescopic rod is hingedly connected to the second diagonal draw bar, and the outer pole is slidably connected to the sliding portion. The traction device comprises a self-lock rope winder disposed on the outer pole, an umbrella rope and a first pulley disposed on the upper end of the inner telescopic rod. The umbrella rope has one end wound on the self-lock rope winder, and the other end bypassing the first pulley to be cooperatively connected to the lower umbrella tray. The elastic element has a lower end cooperatively connected to the outer pole, and an upper end cooperatively connected to the inner telescopic rod.

In an embodiment of the invention, the umbrella rope passes sequentially the outer pole, the inner telescopic rod, the second diagonal draw bar, the first diagonal draw bar and the middle stick.

In an embodiment of the invention, the second pulleys are disposed on both ends of the second diagonal draw bar, the middle portion and an upper end of the first diagonal draw bar, and an upper end of the middle stick, respectively.

In an embodiment of the invention, the inner telescopic rod is inserted into the outer pole, a lower end of the inner telescopic rod is provided with a set of second pulleys cooperatively connected to the outer pole, and an upper end of the outer pole is provided with a set of fourth pulleys cooperatively connected to the inner telescopic rod.

In an embodiment of the invention, a top portion of the inner telescopic rod is provided with a top element, the first pulley is disposed inside the top element, and the second diagonal draw bar is hingedly connected to the top element.

In an embodiment of the invention, the outer pole, the inner telescopic rod, the second diagonal draw bar, the first diagonal draw bar and the middle stick all have a tubular structure, and the umbrella rope passes through sequentially the tubular structures of the outer pole, the inner telescopic rod, the second diagonal draw bar, the first diagonal draw bar and the middle stick.

In an embodiment of the invention, a block is disposed at an end of the umbrella rope connected to the lower umbrella tray, and the lower umbrella tray is provided with a groove connected to the block.

In an embodiment of the invention, a lower end of the outer pole is provided with a base.

In an embodiment of the invention, the elastic element is a gas spring. The gas spring has an upper end hingedly connected to the inner telescopic rod, and a lower end hingedly connected to the outer pole.

In an embodiment of the invention, the elastic element is a spring rod or a spring.

In an embodiment of the invention, the umbrella surface assembly further comprises a set of first cross rods and a set of second cross rods.

The disclosure has reasonable design and compact structure. The structure of the disclosure may make the upper umbrella tray move upward during the process of folding umbrella, thereby lifting the height of the entire umbrella surface assembly. In this way, it may not touch the table under the umbrella and items on the table. At the same time, the structure does not need to increase the height of the umbrella edge, and will not cause poor shading effect because the umbrella edge is too high.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The present invention will be further elaborated hereafter in connection with the drawings.

Figure 1:
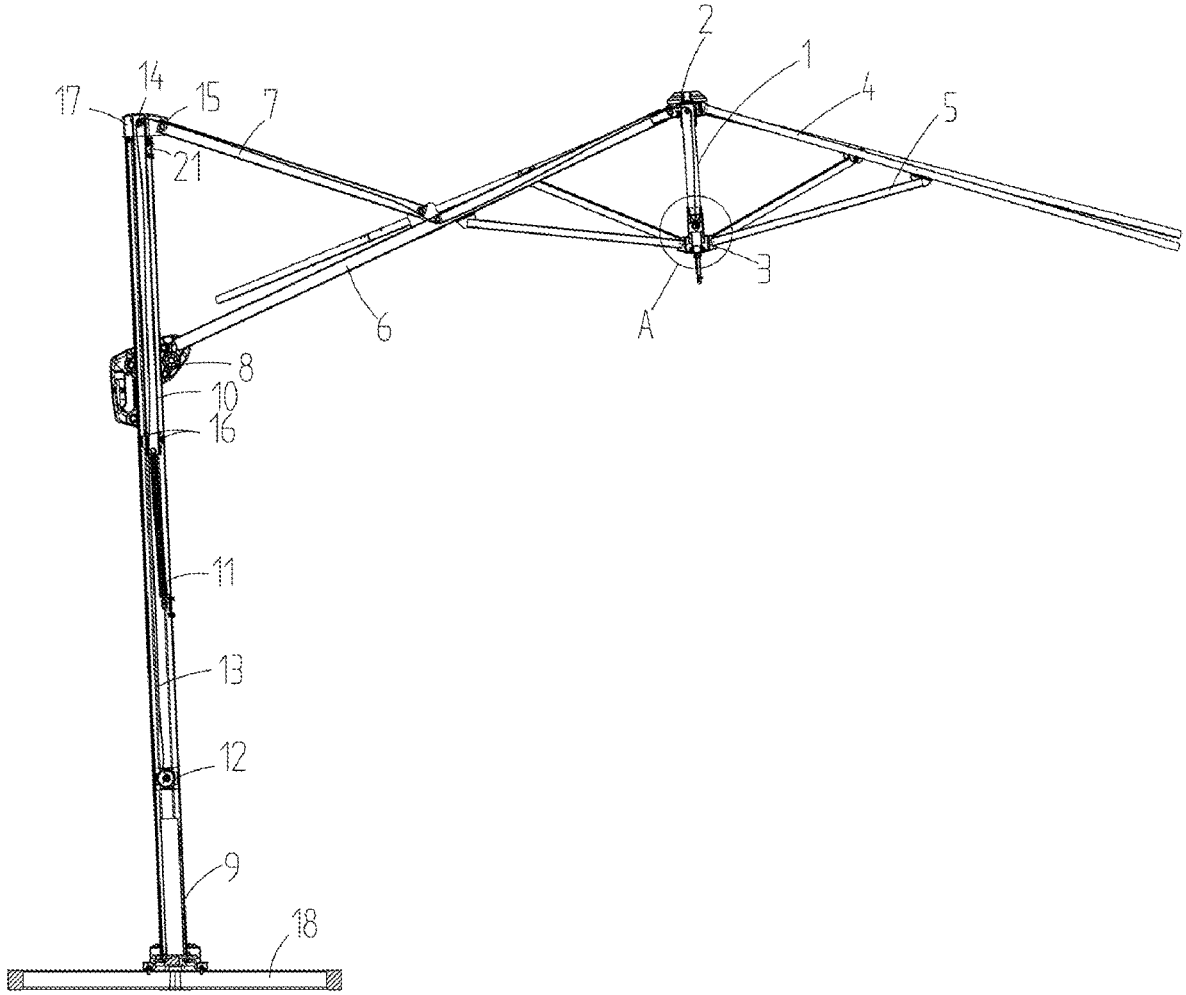
FIG. 1 is a structural view of unfolding umbrella of the disclosure.
Figure 2:
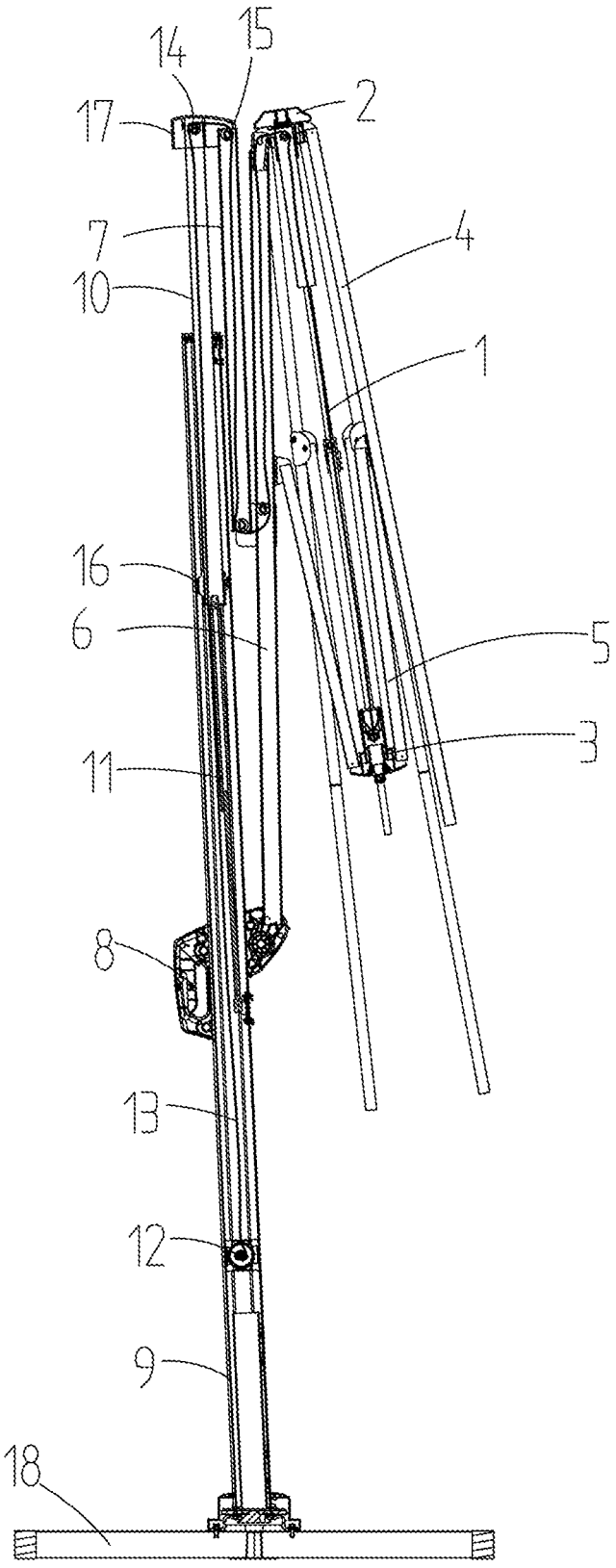
FIG. 2 is a structural view of folding umbrella of the disclosure.
Figure 3:
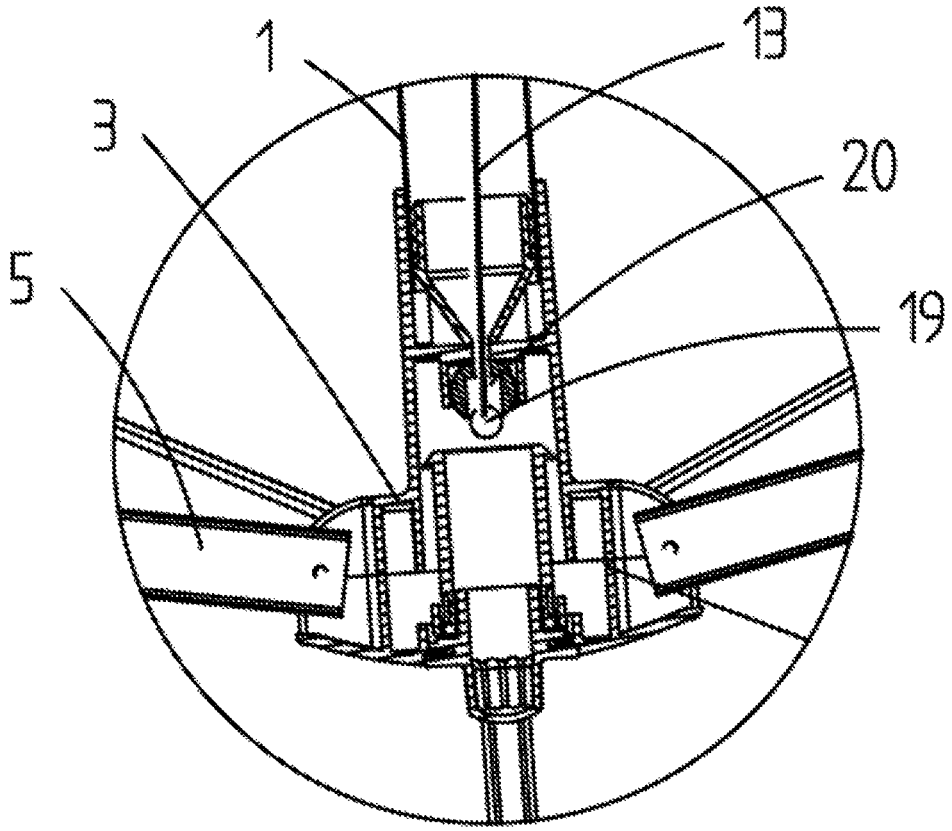
FIG. 3 is an enlarged view of region A in FIG. 1.
Figure 4:
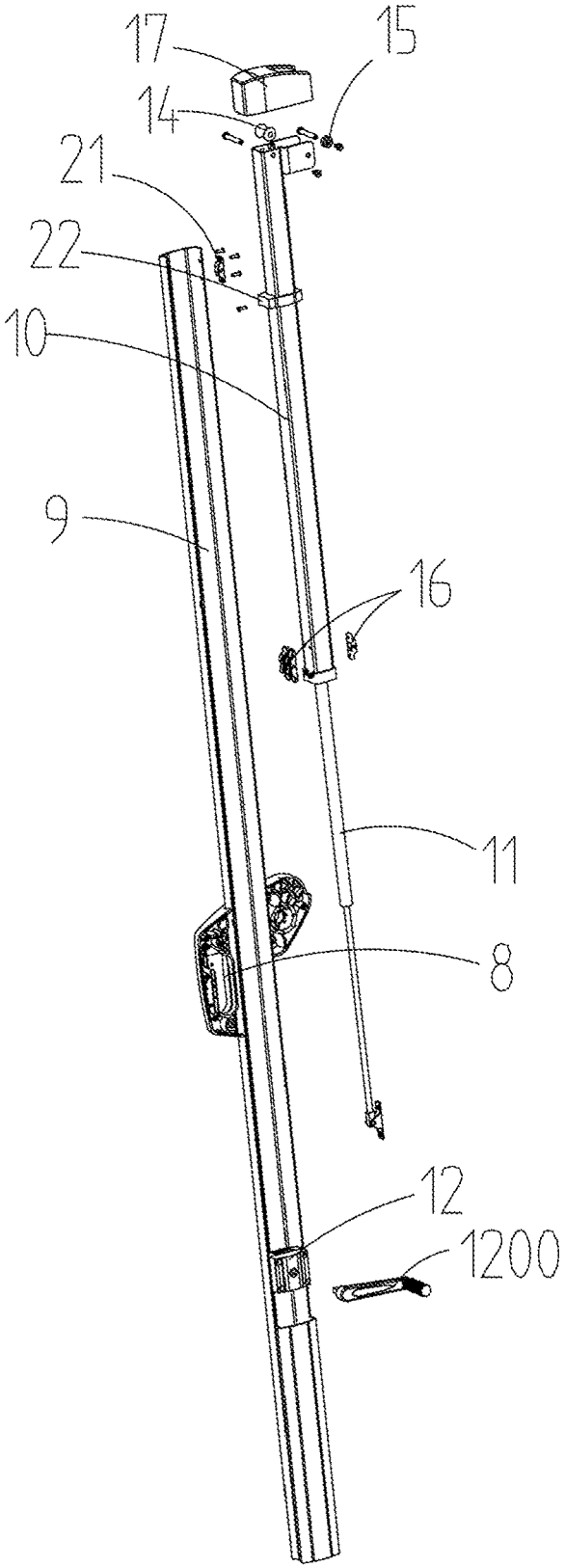
FIG. 4 is a structural view of an outer pole, an inner telescopic rod and an elastic element in the disclosure.
Figure 5:
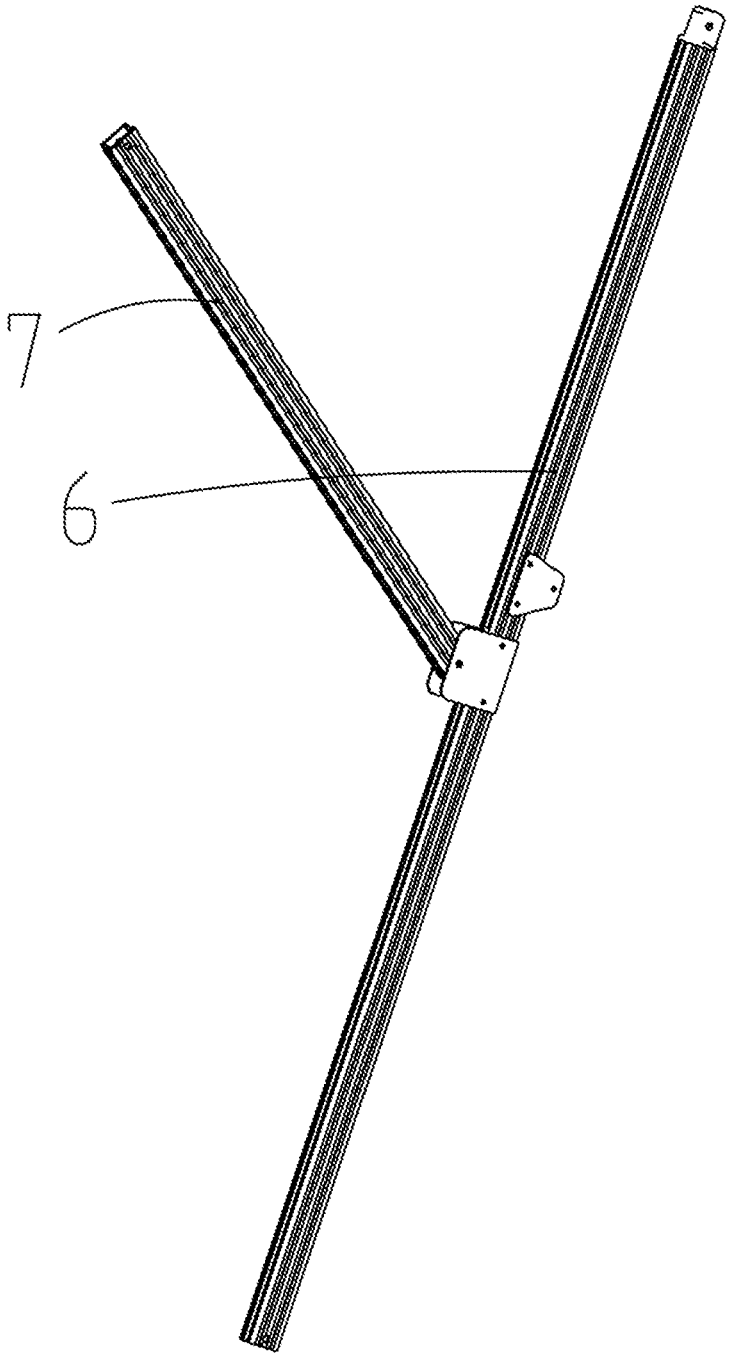
FIG. 5 is a structural view of a first diagonal draw bar and a second diagonal draw bar in the disclosure.

As shown in FIG. 1 to FIG. 5, a shade umbrella for facilitating folding of umbrella surface includes an umbrella surface assembly and a pole assembly that are cooperatively connected to each other. The umbrella surface assembly includes a middle stick 1, an upper umbrella tray 2 and a lower umbrella tray 3, a set of first cross rods 4, a set of second cross rods 5 and an umbrella surface that are cooperatively connected to each other. The connection among the middle stick 1, the upper umbrella tray 2, the lower umbrella tray 3, the first cross rods 4, the second cross rods 5 and the umbrella surface is known art. The middle stick 1 has a telescopic structure. The umbrella surface assembly differs from the prior art in that the upper umbrella tray 2 is hingedly connected to a first diagonal draw bar 6, and a middle portion of the first diagonal draw bar 6 is hingedly connected to a second diagonal draw bar 7. The first diagonal draw bar 6 and the second diagonal draw bar 7 form a Y-shape, and a lower end of the first diagonal draw bar 6 is hingedly connected to a sliding portion 8. The first diagonal draw bar 6, the second diagonal draw bar 7 and the middle stick 1 all have a hollow tubular structure.

The pole assembly includes an outer pole 9, an inner telescopic rod 10 slidably connected to the outer pole 9, a traction device, an elastic element 11, and a base 18 fixedly connected to a lower end of the outer pole 9. The outer pole 9 and the inner telescopic rod 10 have a hollow tubular structure. The inner telescopic rod 10 is inserted into the outer pole and slidably connected thereto, by, specifically, disposing a third pulley 16 slidably connected to an inner wall of the outer pole 9 at front and rear sides of the lower end of the inner telescopic rod 10 respectively, and disposing a fourth pulley 21 slidably connected to an outer wall of the inner telescopic rod 10 on an inner wall of an upper end of the outer pole 9. An upper end of the inner telescopic rod 10 is provided with a fixed element 22, and the fixed element 22 is slidably connected to the inner wall of the outer pole 9, so that the inner telescopic rod 10 may not swing with stable leftward and right ward directions during sliding; together, the fixed element 22, the third pulley 16 and the fourth pulley 21 function to make the inner telescopic rod 10 slide smoothly.

A top portion of the inner telescopic rod 10 is provided with a cover-shaped top element 17, and the top element 17 is hingedly connected to the second diagonal draw bar 7. The sliding portion 8 is sleeved on the outer pole 9 and slidably connected thereto.

The traction device includes a self-lock rope winder 12 disposed in the lower end of the outer pole 9, an umbrella rope 13 and a pulley block for guiding the umbrella rope 13. The self-lock rope winder 12 is also called a self-lock winder, which is a common structure in large shade umbrellas, and is a common art, as well as having a winder shaft capable of winding the umbrella rope 13, a self-lock mechanism for locking the umbrella rope, and a rocking handle 1200 that drives the winder shaft to rotate. The rocking handle 1200 passes out from the housing of the outer pole 9 for facilitating rotation. The pulley block includes a first pulley 14 and a plurality of second pulleys 15, and the second pulleys 15 are disposed on both ends of the second diagonal draw bar 7, the middle portion and an upper end of the first diagonal draw bar 6, and an upper end of the middle stick 1, respectively. The umbrella rope 13 is a nylon rope. The umbrella rope 13 has one end wound on the winder shaft of the self-lock rope winder 12, and the other end passing through sequentially the tubular structures of the outer pole 9, the inner telescopic rod 10, the second diagonal draw bar 7, the first diagonal draw bar 6 and the middle stick 1 while bypassing the first pulley 14 and the above second pulley 15 to finally be cooperatively connected to the lower umbrella tray 3. The umbrella rope 13 is connected to the lower umbrella tray 3 in a way that an end of the umbrella rope 13 connected to the lower umbrella tray 3 is provided with a block 19, and the lower umbrella tray 3 is provided with a groove 20 which is connected to the block 19.

In the disclosure, the elastic element 11 is a gas spring. The gas spring has a lower end hingedly connected to the outer pole 9, and an upper end hingedly connected to the inner telescopic rod 10. Further, the elastic element 11 may also be a spring rod or a spring.

When the umbrella is unfolded, the following processes are performed. The rocking handle 1200 is rotated to drive the self-lock rope winder 12 to rotate for further driving the umbrella rope 13 to tighten, and the umbrella rope 13 pulls the lower umbrella tray 3 to lift, wherein the lower umbrella tray 3 is lifted to the limit, the lower umbrella tray 3 drives the first cross rod 4 and the second cross rod 5 to rotate upward, and the umbrella surface is fully opened. Then, the rocking handle 1200 is rotated continuously, the umbrella rope 13 may exerts downward pressure on the first pulley 14 and thus downward pressure on the inner telescopic rod 10. And then, when the pressure is greater than the elastic force of the elastic element 11, the inner telescopic rod 10 slides downward until the top element 17 and the outer pole 9 are closed, and the self-lock rope winder 12 locks the umbrella rope 13. While the inner telescopic rod 10 slides downward, the upper umbrella tray 2 also moves downward.

When the umbrella is folded, the following processes are performed. The self-lock rope winder 12 loosens the umbrella rope 13, and the rocking handle 1200 is rotated counter-clockwise, then the pressure of the umbrella rope 13 to the inner telescopic rod 10 is less than the elastic force of the elastic element 11, and the elastic element 11 pushes the inner telescopic rod 10 upward to the highest position. Then, the upper umbrella tray 2 is lifted with the inner telescopic rod 10, and at the same time, the end of the second diagonal draw bar 7 connected to the top element 17 is lifted, and the sliding portion 8 is lowered, so that a distance between the second diagonal draw bar 7 and the first diagonal draw bar 6 is increased. As the pulling force of the umbrella rope 13 disappears, the upper umbrella tray 2 is further lifted, and the lower umbrella tray 3 moves downward, driving the first cross rod 4 and the second cross rod 5 to rotate downward, then the umbrella surface is closed to complete the folding of the umbrella.

Obviously, in the method adopted in the prior art to fold the umbrella by moving the lower umbrella tray upward, the height of the upper umbrella tray is fixed. However, in the present disclosure, when the umbrella surface is folded, the inner elastic element 11 pushes up the inner telescopic rod 10, so that the upper umbrella tray 2 moves upward during the process of folding umbrella, thereby lifting the height of the entire umbrella surface assembly. In this way, it may not touch the table under the umbrella and items on the table. At the same time, the structure does not need to increase the height of the umbrella edge, and will not cause a poor shading effect because the umbrella edge is too high.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A shade umbrella for facilitating folding of an umbrella surface, the umbrella comprising an umbrella surface assembly and a pole assembly that are cooperatively connected to each other, wherein the umbrella surface assembly comprises a middle stick, an upper umbrella tray and a lower umbrella tray that are cooperatively connected to each other, the upper umbrella tray is hingedly connected to a first diagonal draw bar, a middle portion of the first diagonal draw bar is hingedly connected to a second diagonal draw bar, and a lower end of the first diagonal draw bar is hingedly connected to a sliding portion; the pole assembly comprises an outer pole, an inner telescopic rod slidably connected to the outer pole, a traction device and an elastic element; an upper end of the inner telescopic rod is hingedly connected to the second diagonal draw bar, and the outer pole is slidably connected to the sliding portion; the traction device comprises a self-lock rope winder disposed on the outer pole, an umbrella rope and a first pulley disposed on the upper end of the inner telescopic rod; the umbrella rope has one end wound on the self-lock rope winder, and the other end bypassing the first pulley to be cooperatively connected to the lower umbrella tray; the elastic element has a lower end cooperatively connected to the outer pole, and an upper end cooperatively connected to the inner telescopic rod.

2. The shade umbrella for facilitating folding of umbrella surface according to claim 1, wherein the umbrella rope passes sequentially the outer pole, the inner telescopic rod, the second diagonal draw bar, the first diagonal draw bar and the middle stick.

3. The shade umbrella for facilitating folding of umbrella surface according to claim 2, wherein the traction device further comprises a plurality of second pulleys disposed on the middle stick, the first diagonal draw bar and the second diagonal draw bar and cooperatively connected to the umbrella rope.

4. The shade umbrella for facilitating folding of umbrella surface according to claim 3, wherein the second pulleys are disposed on both ends of the second diagonal draw bar, the middle portion and an upper end of the first diagonal draw bar, and an upper end of the middle stick, respectively.

5. The shade umbrella for facilitating folding of umbrella surface according to claim 1, wherein the inner telescopic rod is inserted into the outer pole, a lower end of the inner telescopic rod is provided with a set of second pulleys cooperatively connected to the outer pole, and an upper end of the outer pole is provided with a set of fourth pulleys cooperatively connected to the inner telescopic rod.

6. The shade umbrella for facilitating folding of umbrella surface according to claim 1, wherein a top portion of the inner telescopic rod is provided with a top element, the first pulley is disposed inside the top element, and the second diagonal draw bar is hingedly connected to the top element.

7. The shade umbrella for facilitating folding of umbrella surface according to claim 1, wherein a lower end of the outer pole is provided with a base.

8. The shade umbrella for facilitating folding of umbrella surface according to claim 1, wherein the elastic element is a gas spring; the gas spring has an upper end hingedly connected to the inner telescopic rod, and a lower end hingedly connected to the outer pole.

9. The shade umbrella for facilitating folding of umbrella surface according to claim 1, wherein the elastic element is a spring rod or a spring.

10. The shade umbrella for facilitating folding of umbrella surface according to claim 1, wherein the umbrella surface assembly further comprises a set of first cross rods and a set of second cross rods.

* * * * *